US008191883B2

(12) United States Patent
Bader et al.

(10) Patent No.: US 8,191,883 B2
(45) Date of Patent: Jun. 5, 2012

(54) POCKET MANAGEMENT SYSTEM

(75) Inventors: Eric W. Bader, Doylestown, PA (US); Timothy Goszka, Emmaus, PA (US); James Baird, Fogelsville, PA (US); John R. Shaffer, Schnecksville, PA (US); Richard J. Sterner, Allentown, PA (US)

(73) Assignee: Muller Martini Corp., Hauppauge, NY (US)

( * ) Notice: Subject to any disclaimer, the term of this patent is extended or adjusted under 35 U.S.C. 154(b) by 0 days.

(21) Appl. No.: 12/060,317

(22) Filed: Apr. 1, 2008

(65) Prior Publication Data

US 2009/0243179 A1 Oct. 1, 2009

(51) Int. Cl.
*B65H 39/00* (2006.01)
*B65H 5/30* (2006.01)

(52) U.S. Cl. ..... 270/52.14; 270/52.15; 270/52.19; 270/52.23; 270/52.25

(58) Field of Classification Search ..... 270/52.14, 270/52.15, 52.18, 52.19, 52.23, 52.24, 52.25
See application file for complete search history.

(56) References Cited

U.S. PATENT DOCUMENTS 6,907,316 B2 * 6/2005 Bader et al. ..... 700/220

* cited by examiner

*Primary Examiner* — Leslie A Nicholson, III
(74) *Attorney, Agent, or Firm* — Lucas & Mercanti, LLP; Peter J. Phillips

(57) ABSTRACT

A system uses a plurality of sensors to detect and manage conditions within a moving pocket, such as a pocket carrying a flat product from one location to another. The system is particularly useful in connection with a newspaper insert machine. One sensor detects whether the product has been opened properly at a particular time; another sensor detects whether the product has been properly gripped by a gripper at a particular time; another sensor detects whether the pocket is empty at a particular time and another sensor detects whether the pocket is open or closed at a particular time. In the event an error condition is detected, the error condition is corrected by a control system.

5 Claims, 9 Drawing Sheets

POCKET MANAGEMENT SYSTEM

BACKGROUND OF THE INVENTION

1. Field of the Invention

This invention relates to a system for use in sensing and managing the status of various conditions within a pocket as the pocket transports flat products from one location to another. The invention is particularly useful for sensing conditions within, and correcting certain error conditions relating to, moving pockets of a newspaper insert machine.

2. Description of the Related Art

In many machine operations, flat products such as newspapers need to be held in a certain position and transported from one area to another. One machine that is commonly employed in the newspaper and graphic arts industries is an insert machine, for use in automatically inserting flat printed inserts or other products into newspapers at high speed. The products need to be moved between machine devices such as feeders and conveyors. Examples of some prior art, commercially available insert machines are described in U.S. Pat. Nos. 4,723,770; 5,823,320; and 6,907,316, owned by the assignee of the present application. Such patents are incorporated herein by reference.

Insert machines such as those described in the above-mentioned patents typically have three basic sections that operate together in a carefully timed, coordinated fashion. First, a straight-line pocket conveyor moving on a frame is arranged to carry a series of V-shaped or U-shaped pockets along a closed path. For best operation, the pockets are typically oriented vertically or approximately vertically with the open side of the "V" facing up during the insertion process and the pockets are carried horizontally by the conveyor. An example of one type of prior art pocket is shown as element 300 in FIG. 1 of the present application. A prior art pocket of a slightly different, but related, design is shown in FIG. 3.

Each pocket is typically constructed of two flat "walls" of metal or other stiff material hinged together at the bottom. One wall, typically the leading wall, is a fixed wall that stays in a vertical orientation as the pocket moves forward, and the other wall is a moving wall that pivots back and forth relative to the fixed wall at different, timed points along the conveyor. Other devices, such as pocket grippers (see element 330 of FIG. 3) may also be attached to or carried with the pocket.

Mounted above the pocket conveyor are one or more automatic feeder devices. For example, see feeders 200 and 500 shown in FIG. I. The feeders pull sheets or other products from the bottom of a stack in a hopper and feed them down into the pockets as the pockets pass underneath.

In a typical operation, one feeder feeds a folded "jacket" of a newspaper vertically down into the pockets, one jacket per pocket, with the folded side down. Next, one edge of one side of the jacket is gripped by grippers on the pocket, and the other edge falls away or is pulled away to open the jacket. Next, as the pockets move forward, they pass under other feeders that feed inserts down into each jacket. A diagram showing a typical sequence of prior art inserting operations is shown in FIG. 2. Finally, when inserting is complete, a gripper conveyor such as structure 700 of FIG. 1 picks up the completed products from the pockets and carries them away for further handling.

Because of very high machine speeds, damaged inserts or other reasons, "problems" or error conditions can occasionally arise during the insertion process. For example, for whatever reason, a feeder may occasionally fail to feed a jacket, insert or other product into a particular pocket, may feed the product incorrectly, or a product may fall out of the pocket.

Or, after feeding a jacket, which is usually a very thin and flexible newspaper product, if the jacket is not held in place within the pocket correctly, the jacket may fall closed, curl over, fold in on itself, crumple or jam within a pocket, thus preventing inserts from being properly inserted.

A need exists for a system to detect and correct for the above-mentioned error conditions. While some "repair" type systems have been installed on some prior art insert machines, such systems typically corrected for only one or a few types of problems, sometimes did not correctly fix the problem, slowed down the machine, or required manual intervention by an operator. Thus, a need exists for a system to automatically sense, monitor and manage various conditions within a pocket, and to automatically, accurately and quickly compensate for different types of error conditions that may arise.

SUMMARY OF THE INVENTION

The present invention satisfies the above-mentioned needs. A plurality of sensors mounted on a frame detects various conditions within a pocket as the pocket moves past the sensors. Some sensors detect whether or not a product within a pocket is opened or not. Other sensors detect whether pocket grippers have successfully gripped one edge or "folio" of a product jacket. Other sensors detect the presence or absence of a product or a foreign object or debris within the pocket. Still other sensors detect whether the pocket is in an open position or closed position. All sensors are coupled to an electronic control system that signals certain devices of the machine to automatically correct for problems that may have occurred relating to the product or the pocket.

More particularly, in one embodiment, the invention comprises a system for detecting and managing conditions within a pocket, comprising:

a plurality of sensors mounted adjacent to a conveyor carrying a plurality of pockets, each pocket configured to hold and transport a flat product;

the sensors configured to sense whether or not a product within a pocket is unopened, whether or not a product within a pocket has been engaged by a gripper, whether or not a pocket is empty, and whether or not the pocket is in a latched position.

In another embodiment, the invention comprises a system for detecting and managing pocket status and product status conditions relating to moving pockets of an insert machine, comprising:

a plurality of sensors mounted adjacent to a moving conveyor carrying a plurality of pockets, each pocket configured to hold and transport a flat product, each sensor being electrically coupled to a control system;

at least one sensor configured to generate a signal indicative of an unopened product in a pocket, at least one sensor configured to generate a signal indicative of the absence of engagement of a product by a gripper, at least one sensor configured to generate a signal indicative of the presence of an object in a pocket, and at least one sensor configured to generate a signal indicative of a latched status of the pocket.

In another embodiment, the invention comprises a system for detecting, managing and correcting conditions within moving pockets of an insert machine, comprising:

first, second, third and fourth sensors mounted adjacent to a moving conveyor carrying a plurality of pockets, each pocket configured to hold and transport a newspaper product, each sensor being electrically coupled to a control system;

the first sensor configured to detect and send a signal to the control system when the sensor detects whether or not a product is unopened in a pocket at a particular time;

the second sensor configured to detect and send a signal to the control system when the sensor detects whether or not a product within a pocket has been gripped by a gripper at a particular time;

the third sensor configured to detect and send a signal to the control system when the sensor detects whether or not a pocket is empty at a particular time; and the fourth sensor configured to detect and send a signal to the control system when the sensor detects whether or not a pocket is latched at a particular time;

whereby, upon detection of an unopened product error, a non-grip error condition, an empty pocket error or a pocket latched error condition, the control system signals devices on the insert machine to correct the error condition.

BRIEF DESCRIPTION OF THE DRAWINGS

These and other aspects of the present invention may be more fully understood by reference to one or more of the following drawings, in which.

DETAILED DESCRIPTION OF THE INVENTION

The following is a description of one embodiment of the present invention that is particularly useful for detecting, monitoring and managing the conditions of moving pockets and the status of products being carried within the pockets from time to time. The products may be any flat or approximately flat paper, plastic or other flat products, such as newspaper jackets, inserts, sheets, cards, signatures, magazines, books, disks, mail, film packages, etc. The invention is particularly useful for use in connection with a newspaper insert machine, but the invention is not limited to such use. As used herein, the term "pocket" means any device designed to hold a flat or approximately flat product and transport the product from one location to another.

To best understand the purpose and operation of the present invention, it is useful to first examine various operations of a typical insert machine in detail. The machine embodiment of FIGS. 1 and 2 will be used as an example. Although the machine of FIGS. 1 and 2 is an older prior art machine, and newer designs are commercially available today, many of the basic mechanical operations of many of these machines are similar.

Figure 1:
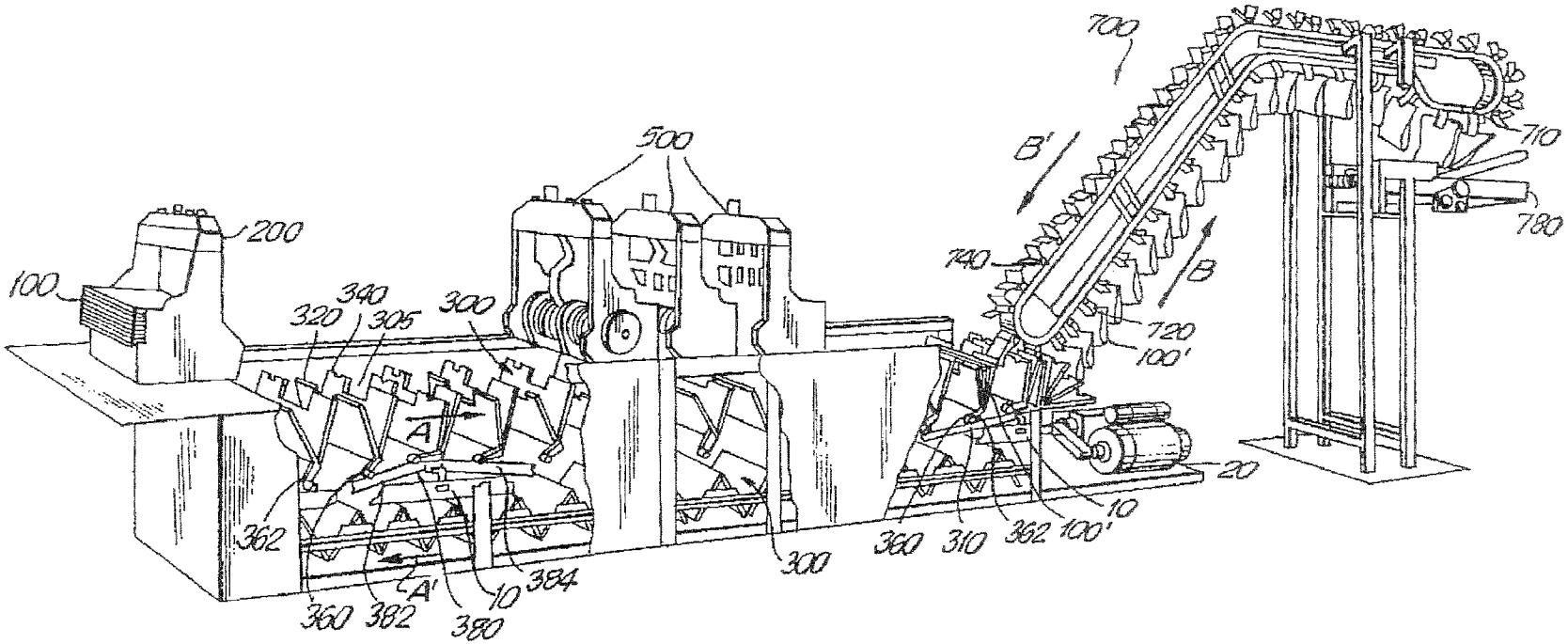
FIG. 1 PRIOR ART
FIG. 1 is a perspective view, partly in section, of a portion of a prior art straight-line insert machine.

Looking at FIG. 1, a stack of newspaper jackets 100 is placed in feeder 200. Feeder 200 is preferably located at or near the "front" of the overall machine. Jackets 100 are fed one by one into moving pockets 300 as pockets 300 pass beneath feeder 200 in direction of travel A of FIGS. 1 and 2. Preferred embodiments of pockets 300 are shown in FIGS. 3-9. Pockets 300 are carried along by a pocket conveyor consisting of one or more roller chains (not shown) or other apparatus, driven by a motor and moving horizontally within the frame of the machine. Feeder 200 is synchronously driven with the movement of pockets 300 and therefore the dispensing speed of feeder 200 matches the linear speed of movement of pockets 300.

Figure 2:
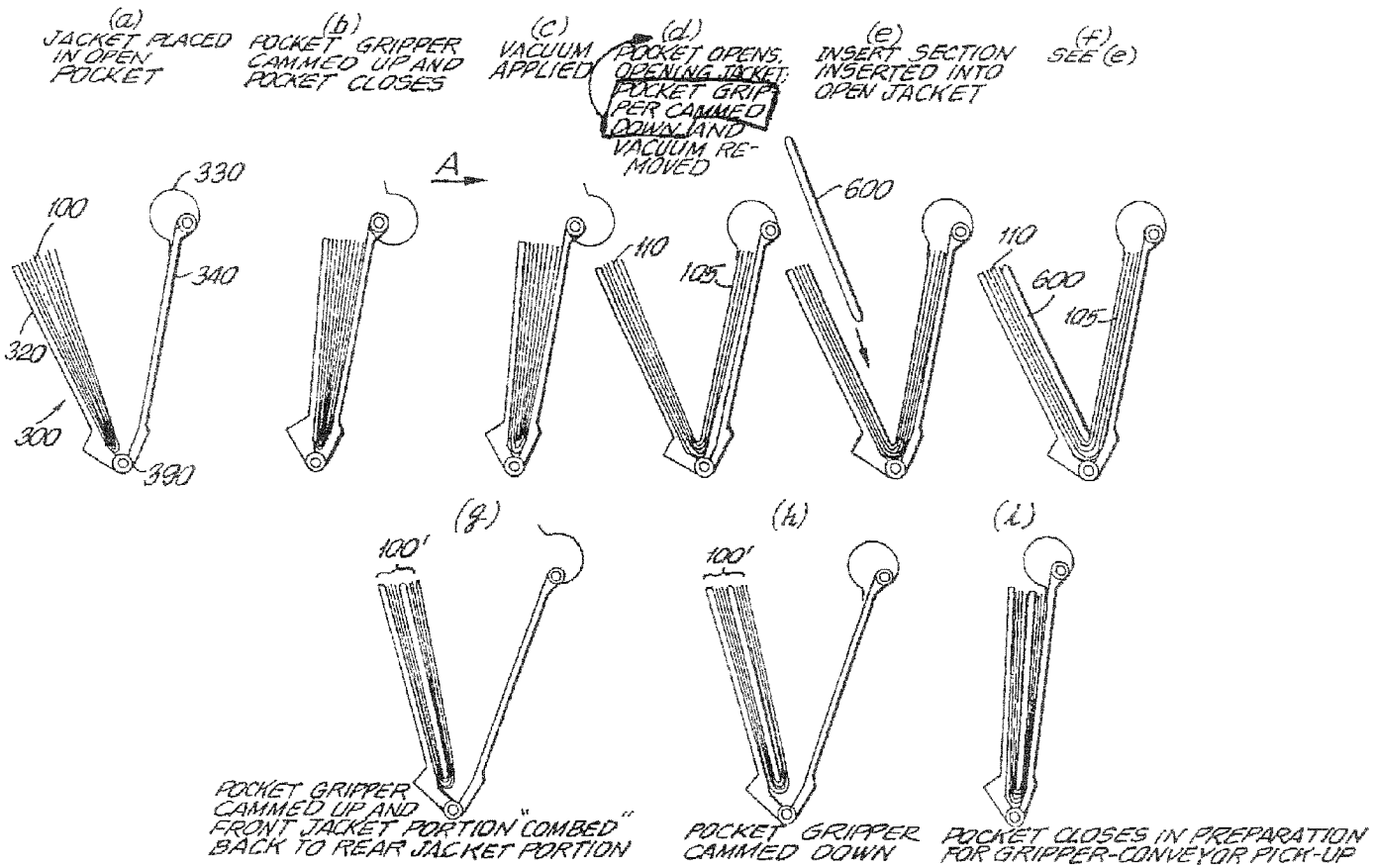
FIG. 2 PRIOR ART
FIG. 2 is a schematic elevational view of a prior art pocket of the machine of FIG. 1 showing typical steps in the process of inserting one insert section into a newspaper jacket.
Figure 3:
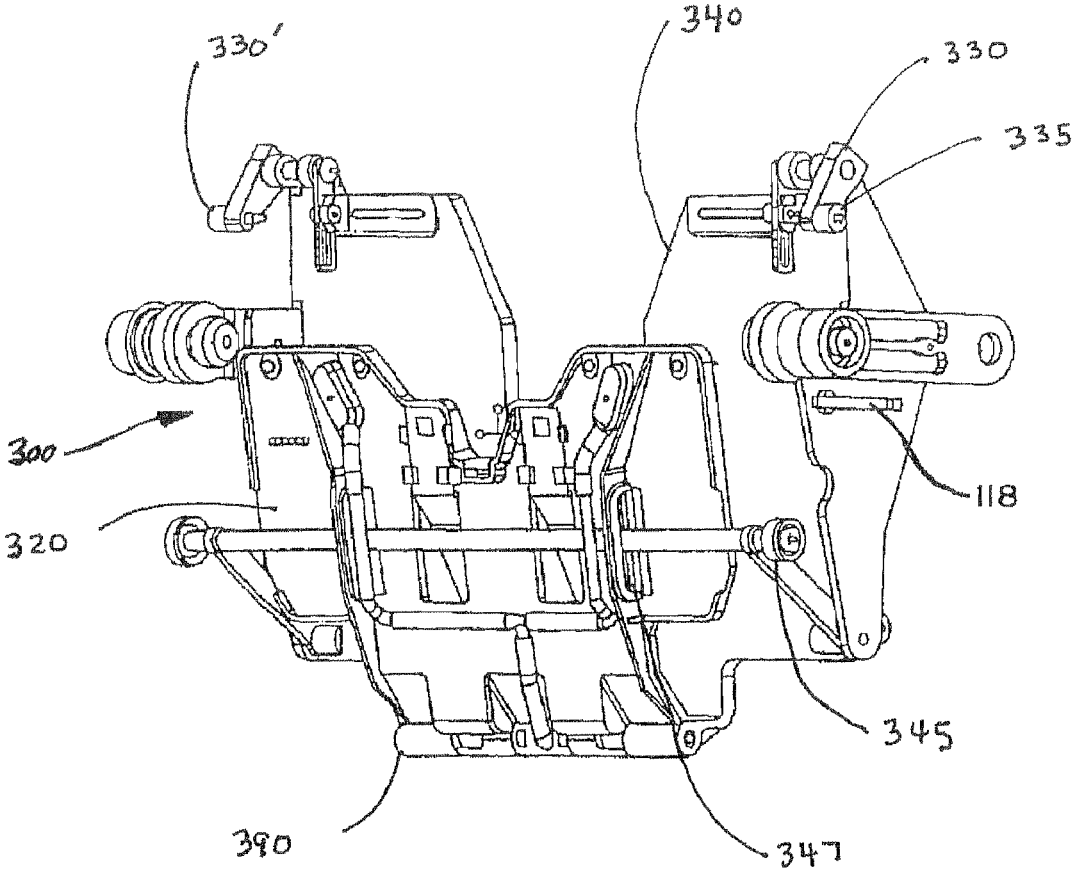
FIG. 3 PRIOR ART
FIG. 3 is a detailed perspective view of a prior art pocket of a slightly different design.

In this embodiment, after jacket 100 has been fed into pocket 300, jacket 100 rests against movable wall 320 of pocket 300, as shown in position (a) of FIG. 2. Movable wall 320 is pivotally attached to fixed wall 340 by hinge 390 (FIG. 2). A cam arrangement opens and closes the pockets at various times. The default condition of a pocket is "closed."

Looking next at FIG. 2, when pocket 300 is in position (a), movable pocket gripper 330, mounted on the top of fixed wall 340 of pocket 300, is in a "down" or closed position. Preferably, two pocket grippers 330, 330' are employed; one on each side pocket 300, as shown in FIGS. 3-9. Each pocket gripper 330, 330' is biased in the down position by spring 332 (FIGS. 4 thru 7).

As pocket 300 travels in direction of travel A in FIGS. 1 and 2, movable wall 320 of pocket 300 pivots toward fixed wall 340 of pocket 300 by cam and cam follower arrangement 360, 380 (FIG. 1), operating in conjunction with pocket opening roller 345 (FIG. 3); pocket grippers 330, 330' are rotated into an "up" position by another cam and cam follower arrangement (not shown); and pocket 300 is closed, as shown in position (b) of FIG. 2.

Next, pocket grippers 330, 330' are released into its down position to grab front portion 105 (high folio) of jacket 100. Then, vacuum is applied to movable wall 320, as shown in position (c) of FIG. 2. Next, as shown in position (d), pocket 300 opens and rear portion of jacket 115 falls open or is pulled open by the vacuum. The purpose of pocket grippers 330, 330' are to hold the top of front jacket portion 105 firmly against fixed wall 340 during positions (d), (e) and (f) of FIG. 2, to prevent jacket 100 from falling closed or curling over or crumpling within pocket 300.

At positions (e) and (f), insert 600 is shown being inserted into open jacket 100 by an overhead feeder (not shown in FIG. 2; see element 500 of FIG. 1). Other downstream feeders (not shown) may insert additional inserts 600 into jacket 300.

After all inserts 600 have been deposited into open jacket 100, pocket grippers 330, 330' are cammed up to position (g) of FIG. 2. Front jacket portion 105 is then "combed" or pulled away from fixed wall 340; pocket grippers 330, 330' cammed down against fixed wall 340 (position (h)); and then pocket 300 is closed to position (i) of FIG. 2. Subsequently, the completed newspaper is removed from pocket 300 by an overhead gripper conveyor 700 (FIG. 1). Finally, pockets 300 are opened and they are conveyed in an upside-down orientation back to the front of the machine to pick up new jackets 100 and inserts in another cycle. The purpose of the upside-down orientation of pockets 300 is to permit foreign objects such as any trash, extra inserts or other inappropriate material to fall out of pockets 300.

Figure 4:
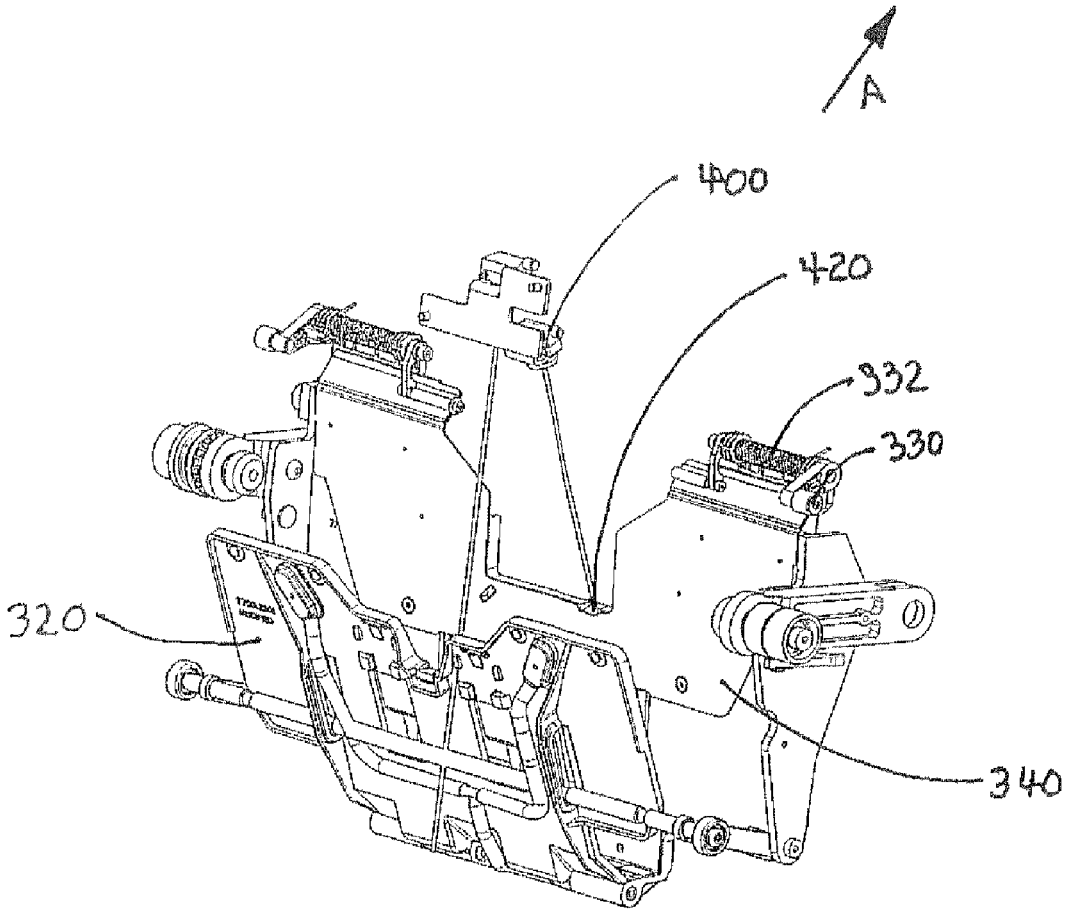
FIG. 4 is a perspective view showing a pocket as it moves past a fixed wall unopened jacket sensor of the present invention.
Figure 5:
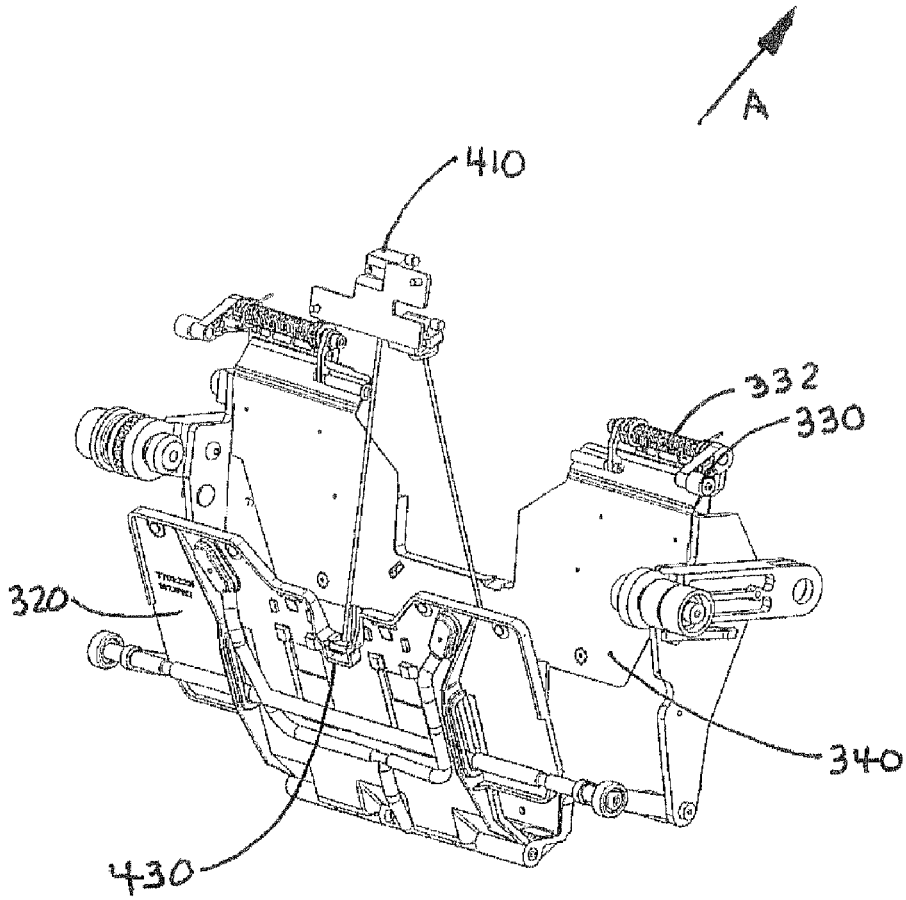
FIG. 5 is a perspective view showing a pocket as it moves past a moving wall unopened jacket sensor of the present invention.

The present invention is illustrated in FIGS. 4-9. FIG. 4 shows fixed wall unopened jacket sensor 400. Similarly, FIG. 5 shows moving wall unopened jacket sensor 410. Both unopened jacket sensors 400, 410 are fixedly attached to the machine frame (not shown) vertically above the center widthwise of fixed wall 340 and moving wall 320 as shown in FIGS. 4 and 5, respectively. Pockets 300 pass beneath two sensors 400, 410. In the illustrations of FIGS. 4 and 5, direction of travel A of pocket 300 is from the lower left to the upper right.

Preferably, each sensor 400, 410 is a retro-reflective sensor that contains an element (not shown) for intermittently transmitting a beam of visible or infrared light, or other signal, and an element (not shown) for receiving the beam or signal. Each sensor is coupled to a source of power and a control system (not shown).

Fixed wall unopened jacket sensor reflector 420 is mounted on the top of fixed wall 340 and moving wall unopened jacket sensor reflector 430 is mounted on top of moving wall 320 as shown in FIGS. 4 and 5, respectively. Each reflector 420, 430 is a passive devise, requiring no source of power. Reflector 420 is positioned such that, as pocket 300 passes under sensor 400, reflector 420 passes directly under sensor 400. Similarly, reflector 430 is positioned such that, as pocket 300 passes under sensor 410, reflector 430 passes directly under sensor 410.

The purpose of the two unopened pocket sensors 400, 410 is to detect whether or not jacket 100 is in pocket 300 and properly opened prior to inserting insert 600. See FIG. 2, position (d). The control system first causes fixed wall unopened pocket sensor 400 to flash a beam or signal at a precise timed instance when reflector 420 has moved directly underneath sensor 400. If jacket 100 is in pocket 300 and properly opened for receiving insert 600, front portion of jacket 105 blocks reflector 420 from beam or signal from sensor 400. The control system then causes moving wall unopened pocket sensor 410 to flash a beam or signal at a precise timed instance when reflector 430 has moved directly underneath sensor 410. If jacket 100 is in pocket 300 and properly opened for receiving insert 600, rear portion of jacket 110 blocks reflector 430 from beam or signal from sensor 410.

If for whatever, jacket 100 is not fed at all into pocket 300, or later falls out of pocket 300, or does not open properly, the control system will "know" from the two unopened pocket sensors 400, 410 that an error has occurred in this particular pocket 300, and that correction is required. Immediately after detection of an "unopened" pocket condition, the machine control system will enter a pocket "repair" mode and send signals to downstream feeders to inhibit them from feeding inserts 600 into this particular pocket 300. The reason for inhibiting the feeders is that inserts 600 cannot be properly inserted into pocket 300 with missing or unopened jacket 100. Gripper conveyor 700 will also be inhibited for this pocket 300 when pocket 300 reaches gripper conveyor 700. As the "problem" pocket 300 starts its return trip back to the front of the machine, since pocket 300 is now open and hanging in upside-down fashion, the "problem" jacket 100 (and any improperly fed inserts or debris) should fall out of pocket 300 so that pocket 300 can be "repaired" during a subsequent pass through the machine. It is not necessary to stop or slow down the entire machine to correct the problem.

Figure 6:
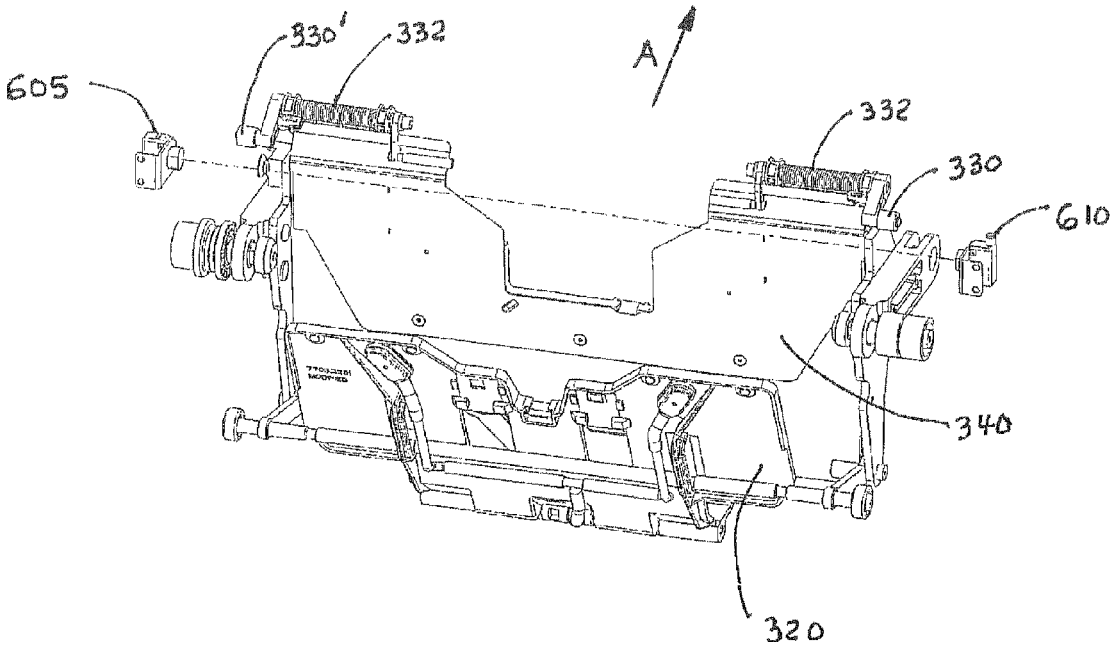
FIG. 6 is a perspective view showing a pocket as it moves past a grip confirmation sensors of the present invention.

FIG. 6 shows a grip confirmation sensor arrangement. This arrangement is also sometimes known as a "Z-sensor" arrangement. In FIG. 6, two sensors 605, 610 are fixedly attached to the machine frame (not shown) on either side of the pocket conveyor (not shown). Pockets 300 pass between sensors 605, 610. In the illustration of FIG. 6, direction of travel A of pockets 300 is from the lower left to the upper right.

Sensor 605 is a transmitting sensor that intermittently transmits a beam of visible or infrared light, or other signal, through pocket 300 to sensor 610, which is a receiving sensor. Other types of sensors could be used instead, if desired. Each sensor 605, 610 is coupled to a source of power and an electronic or electromechanical control system (not shown). The control system causes sensor 605 to flash at a precisely timed instant when each pocket 300 has moved directly between the sensors 605, 610.

The purpose of this sensor arrangement is to confirm whether or not pocket grippers 330, 330' have properly gripped the top of one portion of jacket 100, typically high folio 105. Although gripping of jacket 100 is not shown in FIG. 6, typical gripping steps are illustrated in positions (b), (d)-(f), (h) and (i) of FIG. 2. If both grippers 330, 330' have properly gripped front portion (high folio) of jacket 105, then high folio 105 will be held firmly and flat against fixed wall 340 (leading wall) of pocket 300 as pocket 300 is opened and rear portion of jacket 110 falls open or is pulled open by vacuum, thereby creating a V-shaped open space between front portion 105 and rear portion 110 of jacket 100. As the beam or signal is flashed, the beam will pass all the way through pocket 300; receiving sensor 610 will properly sense the beam; a signal will be properly sent to the control system; and machine operations will continue normally.

If either gripper 330, 330' has not properly gripped front portion (high folio) of jacket 105, front portion (high folio) of jacket 105 most likely will fall away from leading pocket fixed wall 340 and toward trailing pocket moving wall 320, thus closing jacket 100 inappropriately and blocking the desired V-shaped open space between front portion (high folio) of jacket 105 and rear portion of jacket 110. If jacket 100 curls over, crumples or jams within pocket 300 because of a failure to grip, this situation is also unacceptable because inserts 600 from downstream feeders 500 also will not be able to be properly inserted into pocket 300. The present invention detects and corrects for a grip failure condition.

Even if front portion (high folio) of jacket 105 remains relatively straight, jacket 100 may still curl over, crumple or jam within pocket 300. Looked at from the side, the ends of the papers would appear to form a sideways "Z" shape, which is unacceptable because insert 600 and jacket 100 would eventually need to be discarded. Any blockage or obstruction of the V-shaped open space between front portion (high folio) of jacket 105 and rear portion of jacket 110 is an error condition because inserts 600 fed from downstream feeders 500 may not be properly fed between the front and back portions of jacket 100. If this situation occurs, insert 600 would end up sitting loose within pocket 300. Thus, a need exists to detect a non-grip condition as early as possible.

If any of the above-mentioned jacket 100 irregularities occurs, the beam from transmitting sensor 605 will be blocked; receiving sensor 610 will not detect the beam; an expected signal will not be received by the control system; and the control system will "know" that an error has occurred in this particular pocket 300, and that correction is required.

Immediately after detection of a non-grip condition, the machine control system will enter a pocket "repair" mode and send signals to all downstream feeders 500 to inhibit them from feeding inserts 600 into this particular pocket 300. The reason for inhibiting feeders 500 is that inserts 600 cannot be properly inserted into jacket 100 that is not being properly held within pocket 300, namely in a vertical orientation with each portion of jacket 100 being held straight and flat against pocket walls 320, 340. Gripper conveyor 700 will also be inhibited for this pocket 300 when pocket 300 reaches gripper conveyor 700. As the "problem" pocket 300 starts its return trip back to the front of the machine, since pocket 300 is now open and hanging in upside-down fashion, the "problem" jacket 100 (and any improperly fed inserts or debris) should fall out of pocket 300 so that pocket 300 can be "repaired" during a subsequent pass through the machine. It is not necessary to stop or slow down the entire machine to correct the problem.

Another feature of the present invention is that an "obstructed pocket" condition also can be detected and, if necessary, corrected. This condition is different from an "unopened pocket" or a "grip failure" condition in which jacket 100 is improperly fed or positioned for receiving insert 600. As "problem" pocket 300 from one of the above-mentioned error conditions starts its return trip back to the front of the machine, pockets 300 are opened and conveyed in an upside-down orientation back to the front of the machine to pick up new jackets 100 and inserts 600 in another cycle. The purpose of the upside-down orientation of pockets 300 is to permit jacket 100 and/or foreign objects such as any trash, extra inserts or other inappropriate material to fall out of pockets 300. If for whatever reason, jacket 100 and/or foreign material does not fall out of pocket 300, an obstructed pocket condition can be sensed and corrected by the present invention using an arrangement that is illustrated in FIG. 7.

Figure 7:
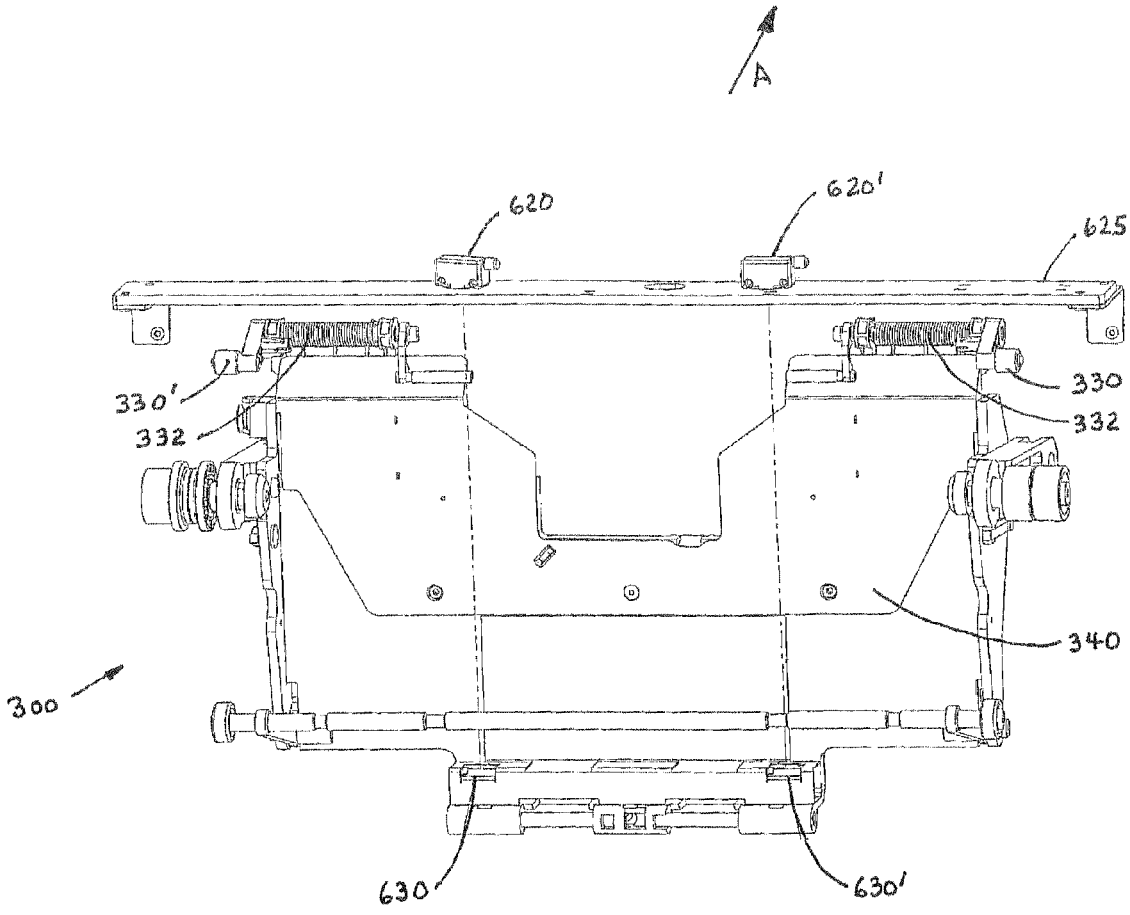
FIG. 7 is a perspective view showing a pocket as it moves past an empty pocket sensors of the present invention.

In FIG. 7, one or more sensors 620, 620' are fixedly mounted on bar or ledge 625 that is fixedly attached to the machine frame (not shown) above the pocket conveyor (not shown), preferably at a point slightly upstream of jacket feeder (element 200 of FIG. 1). In the present embodiment of FIG. 7, two sensors 620, 620' are preferred. Sensors 620, 620' are mounted high enough to permit pockets 300 to pass underneath sensors 620, 620'. In the illustration of FIG. 7, direction of travel A of pockets is 300 from the lower left to the upper right. In this illustration, moving wall 320 is not shown, for purposes of clarity.

Preferably, each sensor 620, 620' is a retro-reflective sensor that contains an element (not shown) for intermittently transmitting a beam of visible or infrared light, or other signal, and an element (not shown) for receiving the beam or signal. Each sensor 620, 620' is coupled to a source of power and a control system (not shown).

Mounted in the bottom of each pocket 300, and moving with the pocket, are one or more reflectors 630, 630'. In the present embodiment, two reflectors are preferred. Each reflector 630, 630' is a passive device, requiring no source of power. Reflector 630 is positioned such that, as pocket 300 passes under sensor 620, reflector 630 passes directly under sensor 620. Similarly, reflector 630' is positioned such that, as pocket 300 passes under sensor 620', reflector 630' passes directly under sensor 620'. The control system causes sensor 620 to flash a beam or signal at a precisely timed instant when reflector 630 has moved directly underneath sensor 620, and causes sensor 620' to flash a beam or signal at a precisely timed instant when reflector 630' has moved directly underneath sensor 620'. Ordinarily, both sensors 620, 620' will flash at the same time.

The purpose of the sensor arrangement of FIG. 7 is to detect whether or not returning pocket 300 is completely empty before inserting new jacket 100 at the start of another cycle. If pocket 300 contains jacket 100 and/or foreign material at a point when it is expected to be empty, namely downstream of jacket feeder 200, the beams from the transmitting elements of sensors 620, 620' will be blocked; the receiving elements of sensors 620, 620' will not receive any reflected beams from reflectors 630, 630'; and no signal will be sent to the control system. Since a "no signal" condition represents an "obstructed pocket" condition, the control system will "know" that an error has occurred in this particular pocket 300, and that correction is required.

Immediately after detection of an "obstructed pocket" 300 condition, the control system will "silence" this pocket 300, and send signals to all downstream feeders 500 to inhibit them from feeding inserts 600 into this particular pocket 300. It is not necessary to stop or slow down the entire machine to correct an "obstructed pocket" type of condition.

In yet another feature of the invention, the invention also assists with the correction of another type of error that may occur at pocket 300, namely a missed insert 600 condition. This feature is illustrated in part in FIGS. 8 and 9. Due to very high machine speeds, damaged inserts or other reasons, insert feeder (such as device 500 of FIG. 1) may occasionally fail to feed insert 600 into a particular pocket 300, perhaps because feeder 500 did not pick up insert 600 from the stack, inserts 600 are stuck together or torn, a jam has occurred, or other condition. A sensor (not shown) mounted on the feeder will normally detect whether particular insert 600 has in fact been inserted into particular pocket 300, and send a signal to the control system accordingly.

In order to correct this missed insert condition, it is not necessary to dump out the entire contents of "problem" pocket 300 and "start over." Rather, pocket 300 and product 100 can be "repaired" by sending it through a second cycle to pick up missing insert 600. In the most preferred form of a repair mechanism, all of the inserting feeders 500 subsequent to the one that was missed are disabled by the control system, for that particular pocket 300. Thereafter, when paper 100 is returned to original missing feeder 500, all of subsequent feeders 500 are enabled.

In this situation, specific "problem" pocket 300 to be recycled must not be opened and emptied when traveling back to the front of the machine, because this would waste jackets 100 and inserts 600 that have already been properly inserted. As previously mentioned, in normal operation, pocket 300 is latched opened and upside-down during its return trip. Latch 118 (FIG. 3) together with other devices (not shown) under the control of the control system keep moving wall 320 opened during this time. Thus, for "problem" pocket 300 with missing insert 600, it is necessary to keep moving wall 320 of "problem" pocket 300 closed during the return path. The present invention does by means of a "moving wall status sensor" 640 (FIGS. 8 and 9) fixedly mounted to the machine frame near the pocket conveyor at a location where pockets 300 are hanging upside down during their return path.

Sensor 640 may be a conventional inductive, capacitive, light-beam or other type of sensor. Sensor 640 is coupled to the control system (not shown). Sensor 640 is positioned to detect whether moving pocket wall 320 is in a closed position or an opened (latched) position as pocket 300 moves past sensor 640 and towards the front of the machine. In particular, sensor 640 is "looking" for the position of pocket opening roller 345.

Figure 8:
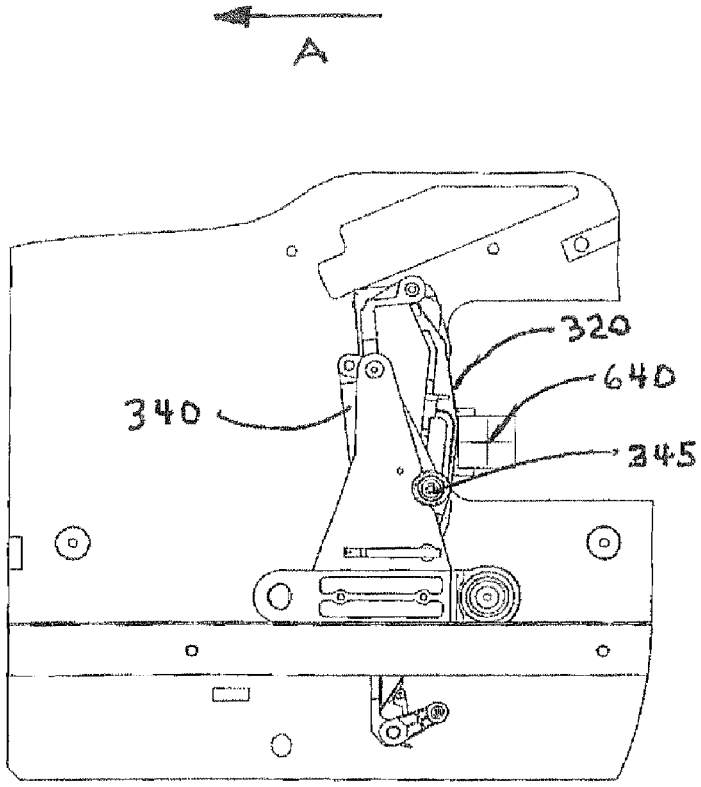
FIG. 8 is a side view of a pocket in a closed position as it moves past a moving wall status sensor of the present invention.

In FIG. 8, moving wall 320 is shown closed, which is the "repair" position in this instance since pocket 300 is incomplete because it is missing inserts 600. Since pocket 300 is moving to the left, it can be seen that roller 345 has passed below sensor 640. In this position, sensor 640 will not sense the roller, a signal will not be sent to the control system, and the control system will "know" that moving wall 320 has correctly been closed.

If sensor 640 detects that moving wall 320 is open when a repair is needed, then an error has occurred, and in that case the control system will record the error and silence the "problem" pocket 300. On the other hand, if the sensor detects that moving wall 320 is closed when a repair is not needed, this is also an error condition, and once again the control system will record the error and silence the "problem" pocket 300.

Figure 9:
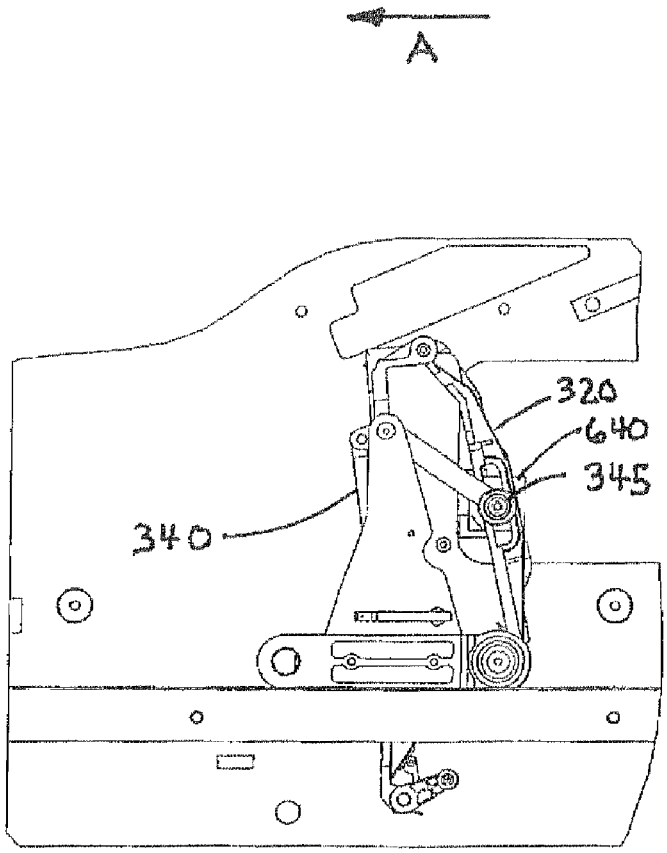
FIG. 9 is a side view of a pocket in an open position as it moves past the moving wall status sensor of the present invention.

FIG. 9 shows moving wall 320 latched opened during pocket 300 return which is the normal expected position during the return trip when a repair is not needed. Since roller 345 has passed in front of sensor 640, sensor 640 will sense roller 345 indicating that moving wall 320 is open, a signal will be sent to the control system, and the control system will "know" that pocket wall 320 is correctly open in this instance.

In another feature of the invention, the various sensors described above can easily be packaged into a relatively inexpensive "retrofit kit" that may be sold separately from the insert machine itself. The sensors are easily installed by a customer onto an existing, already installed insert machine, whether the machine is a current model or an older model. Thus, the customer need not purchase an entirely new insert machine to order to achieve the advantages of this invention.

Although only a few embodiments of the present invention have been expressly disclosed, the invention is, nonetheless, to be broadly construed, and is not to be limited except by the character of the claims appended hereto.

100 Jacket
105 Product High Folio
110 Product Trailing Edge
118 Latch
200 Product Feeder
300 Pocket
320 Moving Wall
330 Pocket Gripper
330' Pocket Gripper
332 Spring
335 Cam
340 Fixed Wall
345 Pocket Opening Roller
347 Slot
390 Hinge
400 Fixed Wall Unopened Jacket Sensor
410 Moving Wall Unopened Jacket Sensor
420 Fixed Wall Unopened Jacket Sensor Reflector
430 Moving Wall Unopened Jacket Sensor Reflector
500 Insert Feeder
600 Insert
605 Grip Confirmation Transmitting Sensor
610 Grip Confirmation Receiving Sensor
620 Retro Reflective Sensor
620' Retro Reflective Sensor
625 Bar or Ledge
630 Reflector
630' Reflector
640 Moving Wall Status Sensor
700 Gripper Conveyor
A Direction of Feeder Pocket

What is claimed is:

1. A system for detecting and managing conditions within pockets of a moveable conveyor which transports products relative to a machine frame, comprising:

a plurality of sensors mounted on a machine frame for producing active sensor steals, said sensors located adjacent to said conveyor carrying a plurality of pockets, said pockets having passive reflectors which reflect signals from the sensors, each pocket configured to hold and transport a flat product;

the sensors configured to sense whether or not a product within a pocket is unopened, whether or not a product within a pocket has been engaged by a gripper, whether or not a pocket is empty, and whether or not the pocket is in a latched position.

2. A system for detecting and managing pocket status and product status conditions relating to moving pockets of an insert machine having a machine frame, comprising:

a plurality of sensors mounted on a machine frame for producing active sensor signals, said sensors located adjacent to a moving conveyor carrying a plurality of pockets, said pockets having passive reflectors which reflect signals from the sensors, each pocket configured to hold and transport a flat product, each sensor being electrically coupled to a control system;

at least one sensor configured to generate a signal indicative of an unopened product in a pocket, at least one sensor configured to generate a signal indicative of the absence of engagement of a product by a gripper, at least one sensor configured to generate a signal indicative of the presence of an object in a pocket, and at least one sensor configured to generate a signal indicative of a latched status of the pocket.

3. A system for detecting, managing and correcting conditions within moving pockets of an insert machine having a machine frame, comprising:

first, second, third and fourth sensors mounted on a machine frame for producing active sensor signals, said sensors located adjacent to a moving conveyor carrying a plurality of pockets, said pockets having passive reflectors which reflect signals from the sensors, each pocket configured to hold and transport a newspaper product, each sensor being electrically coupled to a control system;

the first sensor configured to detect and send a signal to the control system when the sensor detects whether or not a product is unopened in a pocket at a particular time;

the second sensor configured to detect and send a signal to the control system when the sensor detects whether or not a product within a pocket has been gripped by a gripper at a particular time;

the third sensor configured to detect and send a signal to the control system when the sensor detects whether or not a pocket is empty at a particular time; and the fourth sensor configured to detect and send a signal to the control system when the sensor detects whether or not a pocket is latched at a particular time;

whereby, upon detection of an unopened product error, a non-grip error condition, an empty pocket error or a pocket latched error condition, the control system signals devices on the insert machine to correct the error condition.

4. A system for detecting and managing conditions within pockets of a moveable conveyor which transports products relative to a machine frame, comprising:

a plurality of sensors mounted on a machine frame for producing active sensor signals, said sensors located adjacent to said conveyor carrying a plurality of pockets, said pockets having passive reflectors which reflect signals from the sensors, each pocket configured to hold and transport a flat product;

at least one of said sensors configured to sense whether or not a product within a pocket has been engaged by a gripper.

5. A system for detecting and managing conditions within pockets of a moveable conveyor which transports products relative to a machine frame, comprising:

a plurality of sensors mounted on a machine frame for producing active sensor steals, said sensors located adjacent to said conveyor carrying a plurality of pockets, said pockets having passive reflectors which reflect signals from the sensors, each pocket configured to hold and transport a flat product;

at least one of said sensors configured to sense whether or not a pocket is in a latched position.

* * * * *